US010950927B1

(12) United States Patent
West

(10) Patent No.: US 10,950,927 B1
(45) Date of Patent: Mar. 16, 2021

(54) FLEXIBLE SPIRAL ANTENNA

(71) Applicant: Rockwell Collins, Inc., Cedar Rapids, IA (US)

(72) Inventor: James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 16/113,810

(22) Filed: Aug. 27, 2018

(51) Int. Cl.
*H01Q 1/36* (2006.01)

(52) U.S. Cl.
CPC ..... *H01Q 1/36* (2013.01)

(58) Field of Classification Search
CPC ..... H01Q 1/36; H01Q 1/425; H01Q 1/422; H01Q 15/242; H01Q 13/00; H01Q 1/00; H04B 17/00
USPC ..... 343/895
See application file for complete search history.

(56) References Cited

U.S. PATENT DOCUMENTS 5,694,136 A * 12/1997 Westfall ..... H01Q 1/38 343/700 MS
8,269,168 B1 * 9/2012 Axelrod ..... H01Q 5/0086 250/336.1
2007/0208399 A1 * 9/2007 Turner ..... A61N 1/403 607/100
2012/0075069 A1 * 3/2012 Dickey ..... G01L 1/205 340/10.1
2012/0191499 A1 * 7/2012 Pillutla ..... G06Q 10/063112 705/7.14
2012/0194399 A1 * 8/2012 Bily ..... H01Q 5/0006 343/772
2015/0244079 A1 * 8/2015 White ..... H01Q 15/0086 343/913
2018/0076521 A1 * 3/2018 Mehdipour ..... H01Q 13/103
2019/0173191 A1 * 6/2019 Kamali ..... H01Q 1/425
2020/0076077 A1 * 3/2020 Urzhumov ..... H01Q 3/46

OTHER PUBLICATIONS

Radway, Matthew, "Mode Theory of Multi-Armed Spital Antennas and Its Application to Electronic Warfare Antennas", University Of Colorado, Boulder, Jan. 1, 2011, 165 pages.

* cited by examiner

*Primary Examiner* — Huedung X Mancuso
(74) *Attorney, Agent, or Firm* — Suiter Swantz pc llo

(57) ABSTRACT

A flexible spiral antenna or flexible antenna array element includes a flexible dielectric medium, a spiral element including a first arm and a second arm. The spiral element includes a liquid metal material and is disposed in the dielectric medium. The flexible antenna element also includes a first flexible meta surface layer disposed in the dielectric medium. The antenna can be or be part of an ultra-wide frequency band antenna or antenna array.

20 Claims, 7 Drawing Sheets

FLEXIBLE SPIRAL ANTENNA

BACKGROUND

Embodiments of inventive concepts disclosed herein relate generally to antennas including but not limited to a spiral antennas and arrays of spiral antenna elements.

Modern sensing and communication systems may utilize various types of antennas to provide a variety of functions, such as communication, radar, and sensing functions. Antenna arrays are used to perform functions including but not limited to: communication (data and voice) sensing, intelligence gathering (e.g., signals intelligence, or SIGINT), direction finding (DF), electronic countermeasure (ECM) or self-protection (ESP), electronic support (ES), electronic attack (EA) and the like. An antenna array that is low cost, tunable, conformal, low profile, lightweight and are optimized for size, weight, power, and cost (SWAP-C) has advantages for various platforms. Representative platforms include but are not limited to: man pack and ground vehicle, lower tier, small form factor unmanned air vehicles (UAV), and other types of aircraft.

SUMMARY

In one aspect, embodiments of the inventive concepts disclosed herein are directed to a flexible spiral antenna. The flexible spiral antenna includes a flexible dielectric medium, a spiral element including a first arm and a second arm. The spiral element includes a conductive material and is disposed in the dielectric medium. The flexible antenna element also includes a first flexible meta surface layer disposed in the dielectric medium.

In a further aspect, embodiments of the inventive concepts disclosed herein are directed to an antenna system. The antenna system includes a spiral element or a radiating element driven against ground. The antenna system also includes a first high impedance meta surface layer disposed in a dielectric medium comprising first elements, and a second high impedance meta surface layer disposed in the dielectric medium comprising second elements. The first elements have a smaller area than the second elements.

In a further aspect, embodiments of the inventive concepts disclosed herein are directed to a method of manufacturing an antenna. The method includes providing a ground layer, and encapsulating the ground layer in a flexible dielectric medium. The method also includes providing a first flexible meta surface layer above the ground layer, injecting a liquid crystal material in a chamber disposed above the first flexible meta surface layer.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or maybe represented schematically in the interest of clarity. Like reference numerals in the drawings may represent and refer to the same or similar element, feature, or function. In the drawings.

DETAILED DESCRIPTION

Figure 1:
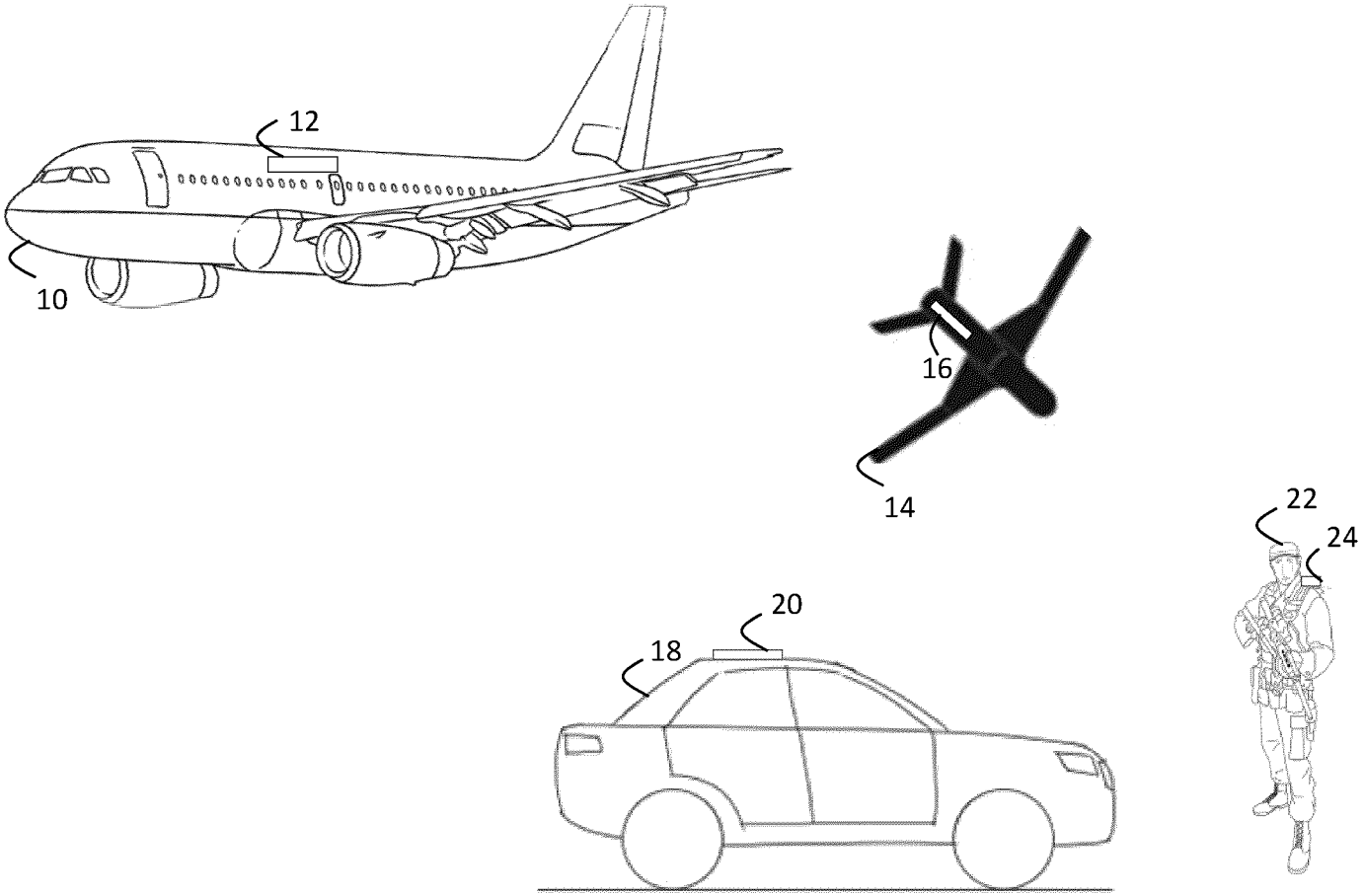
FIG. 1 is a schematic representation of an environment including platforms with spiral antennas according to exemplary aspects of the inventive concepts disclosed herein.

Before describing in detail embodiments of the inventive concepts disclosed herein, it should be observed that the inventive concepts disclosed herein include, but are not limited to a novel structural combination of components and circuits disclosed herein, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the diagrams provided in this disclosure, but should be construed in accordance with the language in the claims.

Some embodiments of the inventive concepts disclosed herein are directed to a spiral antenna that is low cost, tunable, low profile, lightweight and/or optimized for SWAP-C. In some embodiments, systems and method provide a spiral antenna (e.g., a cavity-backed spiral with 2, 4, 6, or more spiral arms) using high performance flexible, meta surface based high impedance surfaces (HIS). In some embodiments, systems and method provide a radiating antenna element driven against ground using high performance flexible, meta surface based high impedance surfaces (HIS). The spiral antenna or radiating antenna element driven against ground has a reduced volume and thickness compared to certain conventional spiral antenna structures and can be conformally attached to a vehicle surface (e.g., an airframe surface) in some embodiments. The spiral antenna or radiating antenna driven against ground is used in electrochromic warfare (EW) systems, communication systems, and direction finding (DF) and signal intelligence (SIGINT) systems in some embodiments. The spiral antenna or radiating antenna driven against ground is used for an ultra wide band controlled pattern reception antenna (CRPA) for global positioning system anti jam (A/J) applications in some embodiments. The spiral antenna or radiating antenna element driven against ground has rotationally symmetric radiation properties in the far field-radiating zone (e.g. beam width, gain, etc.) in some embodiments.

In some embodiments, an ultra-wide band spiral antenna or radiating antenna element driven against ground is backed by HIS. In some embodiments, the spiral antenna is frequency band tunable and the radiation pattern is reconfigurable by designing a phase array of spiral antennas. In some embodiments, the spiral arrays include but are not limited to: a) the class "unconnected" spiral array b) the STAR arrays, c) the connected spiral arrays and d) the tightly coupled interwieved spiral antenna arrays. In some embodiments, the spiral antenna uses liquid metal and stretchable elastomer for a flexible and conformal assembly. By embedding liquid crystal between the antenna and one of the HIS and applying a DC voltage, the dielectric constant of the liquid crystal at the radio frequency and the phase delay of the reflective wave are changed, thereby shifting or tuning the center frequency using constructive reflection phase in some embodiments. The spiral antennas are connected into a spiral electronically scanned aperture antenna array on a flexible, voltage tunable, conformal thin high impedance surface to have a tunable ultra-wide frequency band in some embodiments.

With reference to FIG. 1, platforms such as an aircraft 10, an unmanned aerial vehicle or drone 14, a vehicle 18 and a soldier 22 include antennas 12, 16, 20, and 24. The antennas 12, 16, 20, and 24 are spiral antennas or arrays of spiral antenna elements provided over flexible, conformal metasurfaces in some embodiments. The antennas 12, 16, 20, and 24 are radial antennas or arrays of radiating antenna elements driven against ground and provided over flexible, conformal metasurfaces in some embodiments. In some embodiments, the antennas 12, 16, 20, and 24 provide a transmission signal or receive a signal (e.g., a circularly polarized radio frequency (RF) signal). The antennas 12, 16, 20, and 24 include a flexible layer that conforms to a surface such as an aircraft or watercraft fuselage, the body of a car or truck or a backpack associated with the aircraft 10, drone 14, vehicle 18 and soldier 22 in some embodiments.

The antennas 12, 16, 20, and 24 can be utilized with various receiver/transmitters and beam formers. The manufacturing techniques, configurations, and array patterns described in "Circularly Symmetric Tightly Coupled Dipole Array," U.S. patent application Ser. No. 15/972,608, "Systems And Methods For Wavelength Scaled Array Layout Optimization", U.S. patent application Ser. No. 15/970,781, "Wavelength Scaled Aperture (WSA) Antenna Arrays," U.S. patent application Ser. No. 15/825,711, "Systems And Methods For Ultra-Ultra-Wide Band AESA," U.S. patent application Ser. No. 15/160,959, U.S. Pat. Nos. 9,653,820 and 9,735,469. Each of the above listed applications and patents are incorporated herein by reference in their entireties.

Figure 2:
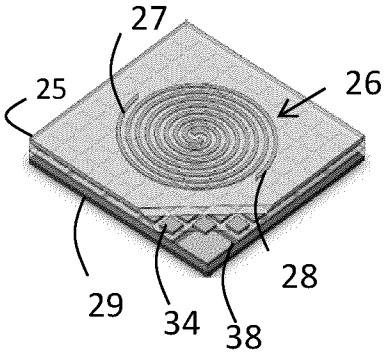
FIG. 2 is a perspective view schematic drawing of a spiral antenna according to exemplary aspects of the inventive concepts disclosed herein.

With reference to FIG. 2, a spiral antenna 25 is an antenna element which is part of an array of antenna elements or is a stand-alone antenna. The spiral antenna 25 is configurable and includes tunable and conformal metasurfaces in some embodiments. In some embodiments, the spiral antenna 25 is simultaneous transmit and receive (STAR) appropriate for full duplex RF wireless system operation.

The spiral antenna 25 is or is part of the antennas 12, 16, 20, and 24. The spiral antenna 25 includes a spiral element 26 including an arm 27 and an arm 28 provided at or near a top of a substrate 29. The spiral antenna 25 is a bi-arm antenna and can also be configured as a quad arm, a six, arm, or other number arm antenna. The spiral antenna 25 is a radiating element driven against ground in some embodiments. The spiral antenna 25 is a classic cavity backed spiral, horizontal printed dipoles above ground, a slot spiral above ground, or a slot antenna above ground in some embodiments. The spiral element 26 is provided in a top plane of the spiral antenna 25 in some embodiments. In some embodiments, the spiral element 26 has a three dimensional shape. In some embodiments, the substrate 29 is flexible and/or curved across one or more radiuses. In some embodiments, the spiral antenna 25 is a class of spiral with reactive and/or resistive arm terminations to reduce the electrical size of the spiral for a given operational bandwidth. In some embodiments, the spiral antenna is a STAR spiral, or a dielectric and magnetically loaded spiral antenna.

Figure 3:
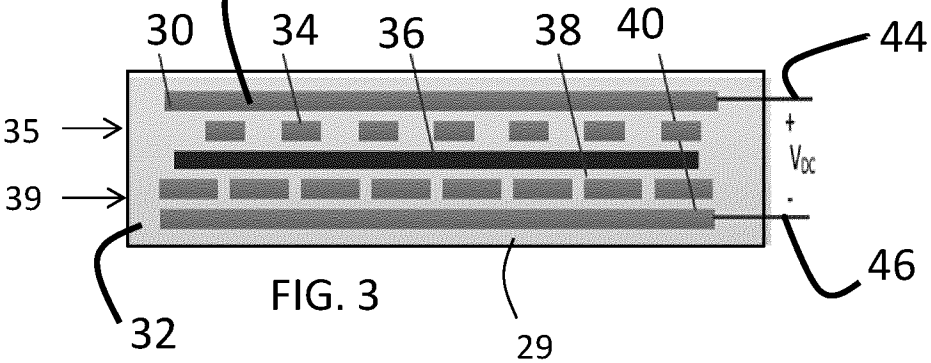
FIG. 3 is a cross sectional view schematic drawing of the spiral antenna illustrated in FIG. 2 according to exemplary aspects of the inventive concepts disclosed herein.

With reference to FIGS. 2 and 3, the substrate 29 of the spiral antenna 25 includes a conductive structure 30 disposed in or on top of a dielectric medium 32 (e.g., a dielectric matrix). The conductive structure 30 provides the arms 27 and 28 of the spiral element 26. The conductive structure 30 is coupled to a connector 44. The connector 44 is coupled to one or both of the arms 27 and 28 in some embodiments. The spiral element 26 is disposed above the substrate 29 which is thin, flexible and conformable.

The substrate 29 includes a metasurface layer 35 including metasurface elements 34, a liquid crystal layer 36, a metasurface layer 39 including metasurface elements 38, and a conductive structure 40. The conductive structure 40 is a ground-biased layer in some embodiments and is coupled to a connector 46. The conductive structure 40 is similar to the conductive structure 30 and includes liquid metal embedded in the dielectric medium 32 in some embodiments. In some embodiments, the metasurface layers 35 and 39 are driven differentially and an additional chassis ground is added to the stack structure.

In some embodiments, all of the elements within the substrate 29 are made from flexible materials. The use of the flexible materials improves structural flexibility and reduces risk of stress related mechanical failure of the spiral antenna 25. The substrate 29 is less than 1 millimeter thick in some embodiments. In some embodiments, the substrate 29 is between 0.5 and 5.0 millimeters thick when the top surface and the bottom surface are planar.

The conductive structure 30 is a liquid metal structure or other conductive material in some embodiments. The liquid metal structure is a caesium, rubidium, francium, gallium, or alloy thereof based metal structure. In some embodiments, the conductive structure 30 includes liquid metal material which is mercury, gallium, and alloys of these metals held in a containing groove in the dielectric medium 32 configured in the shape of the arms 27 and 28. The liquid metal associated with the conductive structure 30 can flow in response to stress and is therefore not prone to fatigue or cracking in some embodiments. In some embodiments, the liquid metal or conductive structure 30 includes Eutectic Gallium-Indium (EGaIn: 75.5% gallium and 24.5% indium) which is a liquid at room temperature, a solid at −14° C., has high electric conductivity, high thermal conductivity, low toxicity, and low weight. The EGaIn material forms a thin oxide skin that provides good chemical stability in some embodiments. In some embodiments, the substrate 29 includes or is disposed near a heating element to maintain the environment at a temperature for appropriate flexibility.

The dielectric medium 32 is a highly flexible medium or matrix, such as, an elastomer (e.g., silicone) in some embodiments. The dielectric medium 32 is a plastic, polymer, or other insulative material in some embodiments. In some embodiments, the dielectric medium and/or the metsurface layers 35 and 39 have controlled static dielectric and/or magnetic loading and also have tunable dielectric/magnetic properties by means of ferroelectric and ferromagentic materials.

The metasurface elements 34 and 38 are high impedance metasurfaces (HIMS) comprised of periodic metal patches and/or wires embedded in elastic polymer, a planar microfabrication structure, a stretchable polymer structure, and/or a liquid metal structure. Liquid metal elements for the metasurface layers 35 and 39 are the same liquid metal material as the conductive structure 30 in some embodiments. The metasurface elements 34 have a larger area than the area of the metasurface elements 38 in some embodiments. In some embodiments, the metasurface elements 34 and 38 are periodic metal patches embedded in an elastic polymer (e.g., the dielectric medium 32, such as highly flexible elastomer). Different sizes of periodic structures or two or multiple layers of the structures can be optimized to have constructive reflections over wide frequency band in some embodiments. In some embodiments, the metasurface layer 35 or the metasurface layer 39 is not utilized and a single metasurface layer structure is provided in the substrate 29. In some embodiments, additional layers of metal surface elements are provided. The metasurface layers 35 and 39 are arranged or configured to have consecutive reflections over a wide frequency band in some embodiments. In some embodiments, the spiral element 26 is a classic cavity backed spiral, a horizontal printed dipole above ground, a slot spiral above ground or a slot antenna above ground, and conventional ground in these structures is replaced with a metasurface such as the metasurface layers 35 and 39 to drastically improve the low profile (height) characteristics, in addition to the advantages of a flexible substrate and tunable meta surface features in some embodiments. A low profile provides conformability for low aerodynamic drag, low observability and potentially low radar cross section (RCS). In some embodiments, the RCS of the structure is tuned with the meta surface.

In some embodiments, the liquid crystal layer 36 includes an arrangement of electro statically controllable nematic liquid crystals. The liquid crystal layer 36 is a modulator layer and is disposed between the conductive structure 30 and the metasurface layer 39 (e.g., between the metasurface layers 35 and 39) in some embodiments. The liquid crystal layer 36 can be used to make the reflection phase of the high impedance metasurface (HIMS) (e.g., the metasurface layers 35 and 39) tunable by using the anisotropy of the liquid crystals in the liquid crystal layer 36 in some embodiments.

Figure 4:
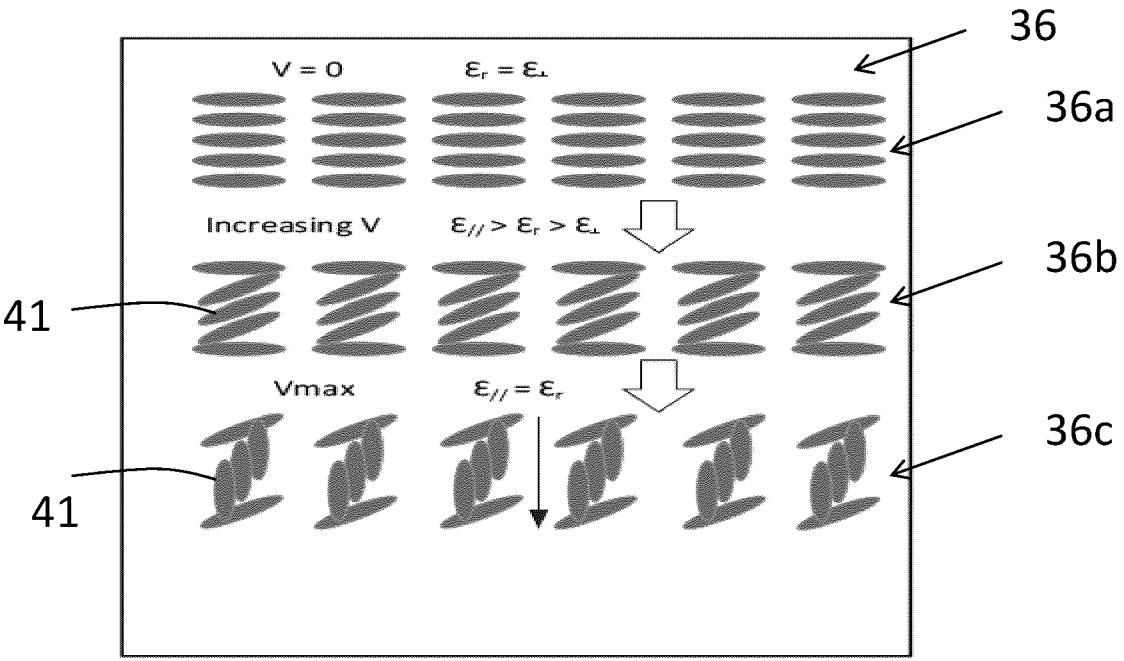
FIG. 4 is a schematic drawing of three orientations of liquid crystals in the spiral antenna illustrated in FIG. 2 according to exemplary aspects of the inventive concepts disclosed herein.

With reference to FIG. 4, the liquid crystals in the liquid crystal layer 36 are in an orientation 36*a* when the voltage across the connectors 44 and 46 is zero or very low, are in an orientation 36*b* when the voltage across the connectors 44 and 46 is at an intermediate state, and are in an orientation 36*c* when the voltage across the connectors 44 and 46 is higher than the intermediate state or a high voltage. The orientation 36*a* is associated with a voltage level at which the liquid crystals are aligned perpendicular to the columns associated with the liquid crystal layer 36, and the orientation 36*c* is associated with a voltage level at which the middle liquid crystals 41 are aligned parallel to the columns. The orientation 36*b* is associated with a voltage level at which the middle liquid crystals 41 are aligned at an angle between parallel and perpendicular to the columns.

The dielectric constant of the liquid crystal layer 36 is tuned by applying a direct current (DC) voltage between the connectors 44 and 46. At microwave frequencies, the liquid crystals in the liquid crystal layer 36 change dielectric properties due to different orientations of its molecules caused by boundary surface anchoring with an alignment layer or application of electrostatic field. The effective dielectric constant as seen by the metasurface layers 35 and/or 39 is at the lowest value when the liquid crystal layer 36 is in the orientation 36*a*. The dielectric constant can be tuned (e.g., static dielectric and/or magnetic loading) using ferroelectric and ferromagentic materials or other dielectric or magnetic embedded tunable materials.

With increasing electrostatic field, the middle liquid crystals 41 align themselves along the vertical electrostatic field direction and the effective dielectric constant changes from the perpendicular orientation value toward the parallel orientation values which increases the effective dielectric constant of the liquid crystal layer 36 until the maximum voltage is reached (e.g., in the orientation 36*c*).

Figure 5:
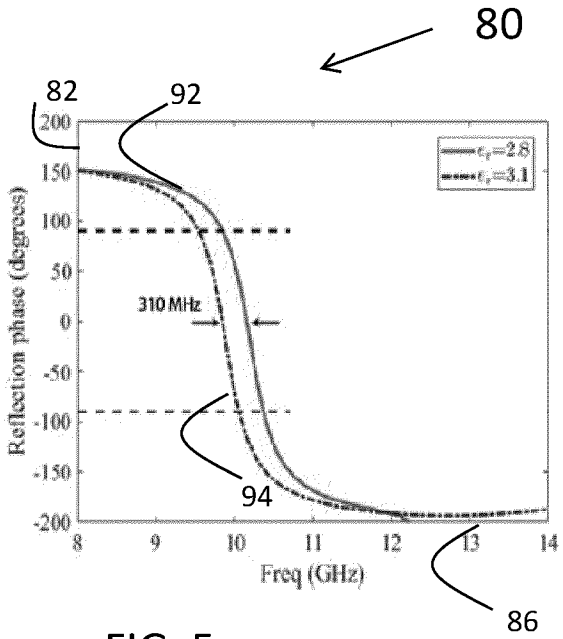
FIG. 5 is a chart showing tuning of reflection phase due to change in the dielectric constant of the liquid crystals in the spiral antenna illustrated in FIG. 2 according to exemplary aspects of the inventive concepts disclosed herein.

With reference to FIG. 5, the frequency response of the metasurface layers 35 and 39 is shifted, as well as the changing in the phase delay of the reflective wave, in response to the changes in liquid crystal orientations of the liquid crystal layer 36. A graph 80 includes a Y-axis 82 representing reflection phase in degrees and an X-axis 86 representing frequency in Gigahertz (GHz). A simulated response 92 at a voltage of 2.8 V and a simulated response 94 at a voltage 3.1 show the ability to tune the spiral antenna 25 (FIG. 1) in a narrow band. The tuning ability can also be used in ultra-wide applications. The tunability as shown in FIG. 5 can also be utilized as an integrated phase shifting mechanism for array beam steering in some embodiments.

With reference to FIG. 1, the spiral antenna 25 can be manufactured by patterning liquid metal-based planar structures at the microscale for the arms 27 and 28 of the spiral element 26, the conductive structure 40, the metasurface layer 35 including metasurface elements 34, and the metasurface layer 39 including metasurface elements 38. In some embodiments, the conductive structure 40 is formed and encapsulated in the dielectric medium 32 such as a layer of Ecoflex silicone. The metasurface layer 39 is formed on top of (e.g., directly on top of) the conductive structure 40. A microfluidic injection process is used to inject the liquid crystal layer 36 into a thin chamber formed above the metasurface layer 39.

The metasurface layer 35 is formed above the chamber, and the spiral element 26 is formed above the metasurface layer 35. The spiral antenna 25 can be formed into particular shapes. Temperatures for increasing flexibility can be applied to the spiral antenna 25. The working frequency band of the layers 35 and 39 can be increased by providing double or multiple layers of periodic structures with each cell being capable of responding to a frequency band.

Figure 7:
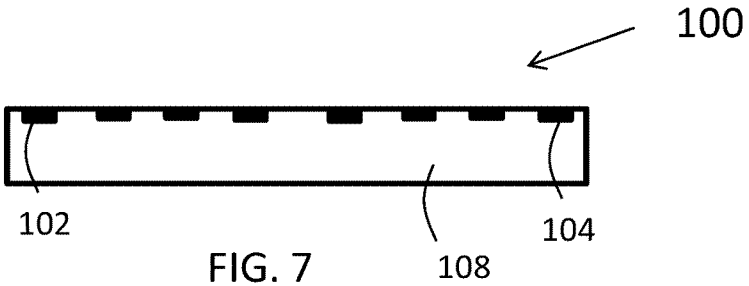
FIG. 7 is a cross sectional view schematic drawing of the spiral antenna illustrated in FIG. 6 about a line 7-7 according to exemplary aspects of the inventive concepts disclosed herein.
Figure 6:
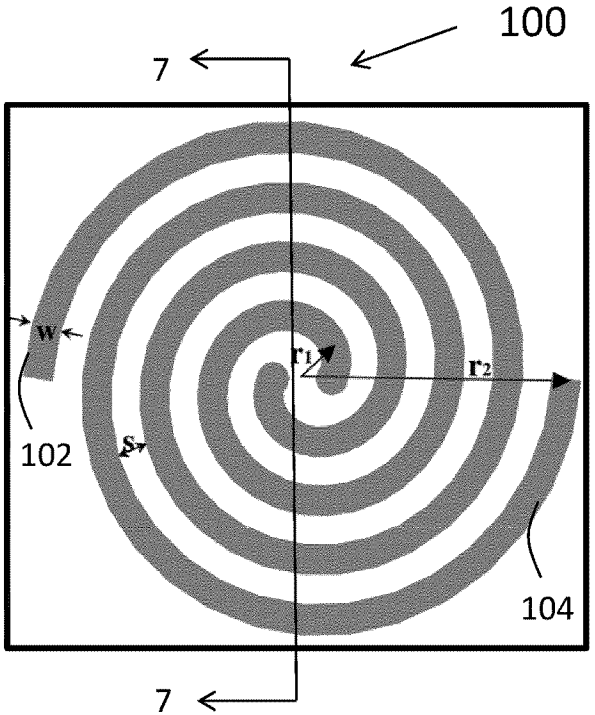
FIG. 6 is a top view schematic drawing of a spiral antenna according to exemplary aspects of the inventive concepts disclosed herein.
Figure 8:
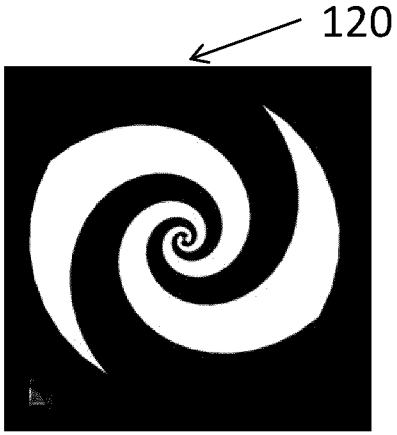
FIG. 8 is a top view schematic drawing of a spiral antenna according to exemplary aspects of the inventive concepts disclosed herein.
Figure 9:
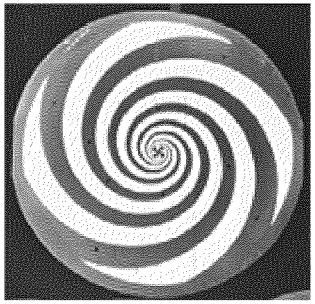
FIG. 9 is a top view schematic drawing of a spiral antenna with four spirals according to exemplary aspects of the inventive concepts disclosed herein.
Figure 10:
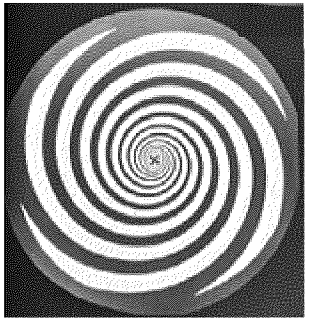
FIG. 10 is a top view schematic drawing of a spiral antenna with four spirals according to exemplary aspects of the inventive concepts disclosed herein.
Figure 11:
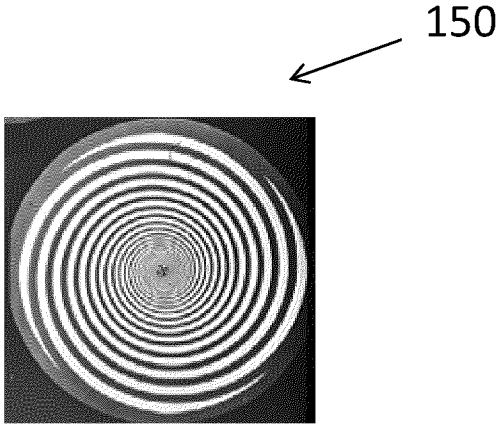
FIG. 11 is a top view schematic drawing of a spiral antenna with four spirals according to exemplary aspects of the inventive concepts disclosed herein.

With reference to FIGS. 6 and 7, a spiral antenna 100 is similar to the spiral antenna 25 (FIG. 2) and includes arms 102 and 104. The width w of the arms 102 and 104, the radius r1, the radius r2, and a width s between the arms 102 and 104 are provided at various values depending upon antenna performance requirements. With reference to FIG. 8, a spiral antenna 120 is similar to the spiral antenna 25 and includes a pair of arms having expanding widths as the arms extend outwardly. With reference to FIG. 9, a spiral antenna 130 is similar to the spiral antenna 25 and includes two pairs of arms having expanding widths as the arms extend outwardly. With reference to FIG. 10, a spiral antenna 140 is similar to the spiral antenna 25 and includes two pairs of arms. With reference to FIG. 11, a spiral antenna 150 is similar to the spiral antenna 25 and includes two pairs of arms in a more compact configuration than the orientation of the spiral antenna 140. Various shapes, sizes, spaces, and radiuses for the arms of the spiral antennas 25, 100, 110?, 120, 130, 140, and 150 can be utilized.

Figure 12:
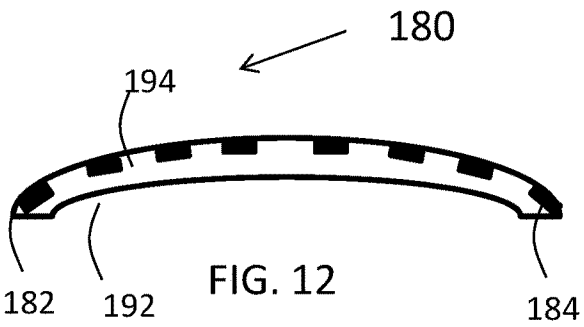
FIG. 12 is a side view schematic drawing of a spiral antenna having a concave surface according to exemplary aspects of the inventive concepts disclosed herein.

With reference to FIG. 12, a spiral antenna 180 is similar to the spiral antenna 25 (FIG. 2) and includes arms 182 and 184 provided on a convex surface 194. A concave surface 192 is opposite the convex surface 194 and is configured to match a platform surface in some embodiments.

The construction and arrangement of the systems and methods as shown in the various exemplary embodiments are illustrative only. Other numbers or types of antenna elements, other polarization configurations and other numbers or types dipole elements can be used. Although only a number of embodiments have been described in detail in this disclosure, many modifications are possible (e.g., variations in sizes, dimensions, structures, shapes and proportions of the various elements, values of parameters, orientations, etc.). For example, the position of elements may be reversed, flipped, or otherwise varied and the nature or number of discrete elements or positions may be altered or varied. Accordingly, all such modifications are included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the scope of the inventive concepts disclosed herein.

What is claimed is:

1. A flexible spiral antenna, comprising:

a dielectric medium, wherein the dielectric medium is flexible;

a spiral element comprising a first arm and a second arm, the spiral element comprising a conductive material, the spiral element being disposed in the dielectric medium; and a first flexible meta surface layer disposed in the dielectric medium; and a liquid crystal layer disposed between the spiral element and the first flexible meta surface layer.

2. The flexible spiral antenna of claim 1, wherein the conductive material comprises Eutectic Gallium-Indium.

3. The flexible spiral antenna of claim 2, wherein the first flexible meta surface layer comprises Eutectic Gallium-Indium.

4. The flexible spiral antenna of claim 1, further comprising:

a second flexible meta surface layer disposed in the dielectric medium.

5. The flexible spiral antenna of claim 1, further comprising:

a second flexible meta surface layer disposed in the dielectric medium; and wherein the liquid crystal layer is disposed between the second flexible meta surface layer and the first flexible meta surface layer.

6. The flexible spiral antenna of claim 1, further comprising:

a second flexible meta surface layer disposed in the dielectric medium; and a ground layer, wherein the second flexible meta surface layer is disposed between the liquid crystal layer and the spiral element.

7. The flexible spiral antenna of claim 6, wherein a voltage applied across the ground layer and the spiral element adjusts a frequency response of the flexible spiral antenna.

8. The flexible spiral antenna of claim 1, wherein the flexible spiral antenna is less than 1 millimeter thick.

9. The flexible spiral antenna of claim 1, wherein the flexible spiral antenna is an antenna element in an array of antenna elements, wherein the array is anunconnected spiral array, a STAR array, a connected spiral arrays, or a tightly coupled interwieved spiral antenna array.

10. A method of manufacturing an antenna, the method comprising:

providing a ground layer;

encapsulating the ground layer in a flexible dielectric medium;

providing a first flexible meta surface layer above the ground layer; and injecting a liquid crystal material in a chamber disposed above the first flexible meta surface layer;

providing a second flexible meta surface layer above the ground layer; and providing a spiral antenna layer above the second flexible meta surface layer.

11. The method of claim 10, wherein the liquid crystal material is between the second flexible meta surface layer and the first flexible meta surface layer.

12. The method of claim 11, wherein the spiral antenna layer is a liquid metal layer.

13. The method of claim 10, wherein the ground layer, the first flexible meta surface layer, the second flexible meta surface layer above the ground layer, and the spiral antenna layer comprise liquid metal material.

14. The method of claim 10, wherein the spiral antenna layer comprises four arms.

15. The method of claim 10 wherein the first flexible meta surface layer is a high impedance surface layer.

16. A method of manufacturing an antenna, the method comprising:

providing a ground layer;

encapsulating the ground layer in a flexible dielectric medium;

providing a first flexible meta surface layer above the ground layer; and providing a second flexible meta surface layer above the ground layer; and providing a spiral element comprising a first arm and a second arm, the spiral element comprising a conductive material, the spiral element being disposed in the flexible dielectric medium; and providing a liquid crystal layer between the second flexible meta surface layer and the first flexible meta surface layer.

17. The method of claim 16, further comprising:

wherein the liquid crystal layer is between the second flexible meta surface layer and the first flexible meta surface layer.

18. The method of claim 16, further comprising:

wherein the spiral element is provided in a liquid metal layer.

19. The method of claim 16, wherein the ground layer, the first flexible meta surface layer, the second flexible meta surface layer above the ground layer, and the spiral element comprise liquid metal material and wherein the first flexible meta surface layer is a high impedance surface layer.

20. The method of claim 16, wherein the spiral element comprises four arms.

* * * * *